US007476180B1

(12) United States Patent
Cobb

(10) Patent No.: US 7,476,180 B1
(45) Date of Patent: Jan. 13, 2009

(54) EXERCISE APPARATUS FOR THE JAW AND FACIAL MUSCLES

(76) Inventor: Tyrone Cobb, P.O. Box 11294, Jackson, MS (US) 39283

( * ) Notice: Subject to any disclaimer, the term of this patent is extended or adjusted under 35 U.S.C. 154(b) by 70 days.

(21) Appl. No.: 11/412,394

(22) Filed: Apr. 28, 2006

(51) Int. Cl.
*A63B 23/03* (2006.01)

(52) U.S. Cl. ..... 482/11; 601/38; 482/122

(58) Field of Classification Search ..... 482/10, 482/11, 121, 122; 128/859, 861, 862; 601/38
See application file for complete search history.

(56) References Cited

U.S. PATENT DOCUMENTS

| | | | | | |
|---|---|---|---|---|---|
| 1,714,029 | A * | 5/1929 | Kuhn | 482/11 |
| 1,851,865 | A * | 3/1932 | Ptacek | 482/11 |
| 2,590,118 | A * | 3/1952 | Oddo, Jr. | 128/861 |
| 4,280,696 | A * | 7/1981 | Ramon | 482/11 |
| 4,650,182 | A | 3/1987 | Ross | |
| 5,562,105 | A | 10/1996 | Syrop et al. | |
| 5,582,560 | A * | 12/1996 | Magnuson | 482/111 |
| 5,855,535 | A * | 1/1999 | Shafer | 482/11 |
| D444,504 | S | 7/2001 | Man | |
| 6,514,176 | B1 | 2/2003 | Norton | |
| 6,524,262 | B1 * | 2/2003 | Akihiro | 601/38 |
| 6,626,664 | B1 * | 9/2003 | Bergersen | 433/6 |
| 7,438,667 | B2 * | 10/2008 | Robbins et al. | 482/11 |
| 2003/0078139 | A1 | 4/2003 | Norton | |

* cited by examiner

*Primary Examiner*—Glenn Richman
(74) *Attorney, Agent, or Firm*—Crossley Patent Law; Mark A. Crossley

(57) ABSTRACT

An exercise apparatus for the jaw and facial muscles has a pair of unshaped plates sized to fit within a human mouth has front, back, left, and right edges, and upper and lower sides is disclosed. A connection means at the back edge can be a hinge. There can be inner and outer walls extending from the plates to form a channel that engages the user's teeth. The hinge provides resistance and can be a spring loaded hinge assembly.

1 Claim, 4 Drawing Sheets

EXERCISE APPARATUS FOR THE JAW AND FACIAL MUSCLES

BACKGROUND OF THE INVENTION

Many offerings exist by which the jaw muscles may be exercised and strengthened. The devices offered, however, do not solve all problems associated with isolation of the jaw muscles and ease of use.

FIELD OF THE INVENTION

The present invention relates to an exercise apparatus for the jaw and facial muscles for use in connection with increasing the tone and strength of the jaw and facial muscles. The exercise apparatus for the jaw and facial muscles has particular utility in connection with strengthening jaw muscles thereby increasing the toning of the muscles and the overlying skin to improve. This results in both increased strength and improved appearance.

DESCRIPTION OF THE PRIOR ART

The use of exercise devices for the jaw and facial muscles is known in the prior art. For example, U.S. Pat. No. 6,514,176 to Norton discloses an apparatus for enhancing isometrics exercise and methods of using the same. However, the Norton '176 patent does not have similar structure as it is designed to fit within the user's lips instead of inside the mouth as in the present device, and has the further drawback of not promoting movement of the jaws.

U.S. Pat. No. 5,855,535 to Shafer discloses a jaw muscle exercise device that fits inside the user's mouth. However, the Shafer '535 patent does not have similar structure as the present device as it is deformed through pressure during use and presses against the user's inner cheeks unlike the present invention, and additionally is not capable of full compression of the jaws.

While the above-described devices fulfill their respective and particular objects and requirements, they do not describe an exercise apparatus for the jaw and facial muscles that provides for the advantages of the present invention; therefore, a need exists for an improved exercise apparatus for the jaw and facial muscles, particularly one that includes a full range of movement and that fits within the user's mouth. Additionally, through the use of a spring, the present invention is capable of requiring a wide range of compressive forces to utilize and is thus suited for use in a variety of rehabilitative situations.

In this respect, the present invention substantially departs from the conventional concepts and designs of the prior art.

SUMMARY OF THE INVENTION

In view of the foregoing disadvantages inherent in the known types of exercise devices for the jaw and facial muscles now present in the prior art, the present invention provides an improved exercise apparatus for the jaw and facial muscles, and overcomes the above-mentioned disadvantages and drawbacks of the prior art. As such, the general purpose of the present invention, which will be described subsequently in greater detail, is to provide a new and improved exercise apparatus for the jaw and facial muscles and method which has all the advantages of the prior art mentioned heretofore and many novel features that result in an exercise apparatus for the jaw and facial muscles which is not anticipated, rendered obvious, suggested, or even implied by the prior art, either alone or in any combination thereof.

To attain this, the present invention essentially is a pair of generally u-shaped first and second plates that are sized to fit within a human mouth. The plates have front, back, left, and right edges, and upper and lower sides. There is a connection means at the back edge, which is preferably a hinge.

There is also an inner wall and an outer wall extending outwardly from the plates to form a channel. Thus the upper side of the first plate has a channel, and the lower side of the second plate has a channel. The channel is adapted to engage the user's teeth. The hinge can be used to provide resistance, and can be a spring loaded hinge assembly.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

It is therefore an object of the present invention to provide a new and improved exercise apparatus for the jaw and facial muscles that has all of the advantages of the prior art exercise devices for the jaw and facial muscles and none of the disadvantages.

It is another object of the present invention to provide a new and improved exercise apparatus for the jaw and facial muscles that may be easily and efficiently manufactured and marketed.

An even further object of the present invention is to provide a new and improved exercise apparatus for the jaw and facial muscles that has a low cost of manufacture with regard to both materials and labor, and which accordingly is then susceptible to low prices of sale to the consuming public, thereby making such exercise apparatus for the jaw and facial muscles economically available to the buying public.

Still another object of the present invention is to provide a new exercise apparatus for the jaw and facial muscles that provides in the apparatuses and methods of the prior art some of the advantages thereof, while simultaneously overcoming some of the disadvantages normally associated therewith.

Even still another object of the present invention is to provide an exercise apparatus for the jaw and facial muscles for increasing muscle development. This allows the user to recover more rapidly from a stroke or similar disease, such as Bell's palsy.

Still yet another object of the present invention is to provide an exercise apparatus for the jaw and facial muscles for improving skin tone through improved musculature. This makes it possible to decrease the appearance of aging for many users.

Thus has been broadly outlined the more important features of the exercise apparatus for the jaw and facial muscles so that the detailed description thereof that follows may be better understood and in order that the present contribution to the art may be better appreciated.

Numerous objects, features and advantages of the exercise apparatus for the jaw and facial muscles will be readily apparent to those of ordinary skill in the art upon reading the following detailed description of presently preferred, but nonetheless illustrative, embodiments of the exercise apparatus for the jaw and facial muscles when taken in conjunction with the accompanying drawings. In this respect, before explaining the current embodiments of the exercise apparatus for the jaw and facial muscles in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the exercise apparatus for the jaw and facial muscles. It is therefore important that the claims be regarded as including such equivalent constructions insofar as they do not depart from the spirit and scope of the present invention.

These together with additional objects of the exercise apparatus for the jaw and facial muscles, along with various novel features that characterize the invention are particularly pointed out in the claims forming a part of this disclosure. For better understanding of the exercise apparatus for the jaw and facial muscles, its operating advantages and specific objects attained by its uses, refer to the accompanying drawings and description.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numbers refer to the same parts throughout the various figures.

DETAILED DESCRIPTION OF THE PREFERRED EMBODIMENT

Figure 1:
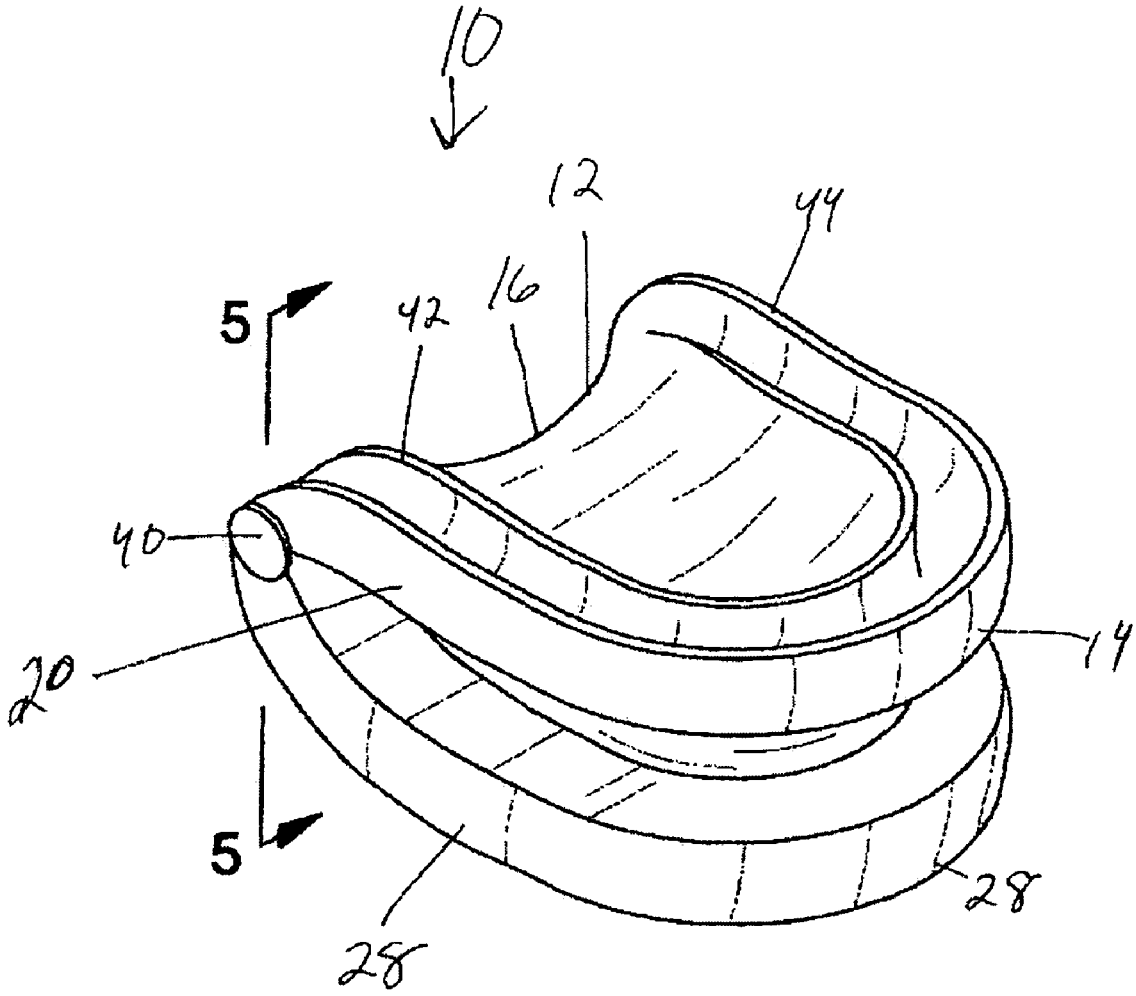
FIG. 1 is a perspective view of the preferred embodiment of the exercise apparatus for the jaw and facial muscles constructed in accordance with the principles of the present invention.

Referring now to the drawings, and particularly to FIGS. 1-5, a preferred embodiment of the exercise apparatus for the jaw and facial muscles of the present invention is shown and generally designated by the reference numeral 10.

In FIG. 1, a new and improved exercise apparatus for the jaw and facial muscles 10 of the present invention for increasing jaw muscle toning is illustrated and will be described. More particularly, the exercise apparatus for the jaw and facial muscles 10 is a generally u-shaped first plate 12 and a generally u-shaped second plate 26. The plates 12 and 26 have front 14 and 28, back 16 and 30, left 18 and 32, and right edges 20 and 34, as well as upper 22 and 36, and lower sides 24 and 38. The plates 12 and 26 are sized to fit within a human mouth. The plates 12 and 26 are joined at the back edges 16 and 30 by a connection means 40. The first plate 12 has an inner wall 42 and an outer wall 44 that extends upwardly from the first plate upper side 22 to form a channel 46. The channel 46 is adapted to engage the user's teeth. The second plate 26 also has an inner wall 48 and an outer wall 50 that extends downwardly from the second plate lower side 38 to form a channel 52, but only the outer wall 50 can be seen in this Figure.

Figure 2:
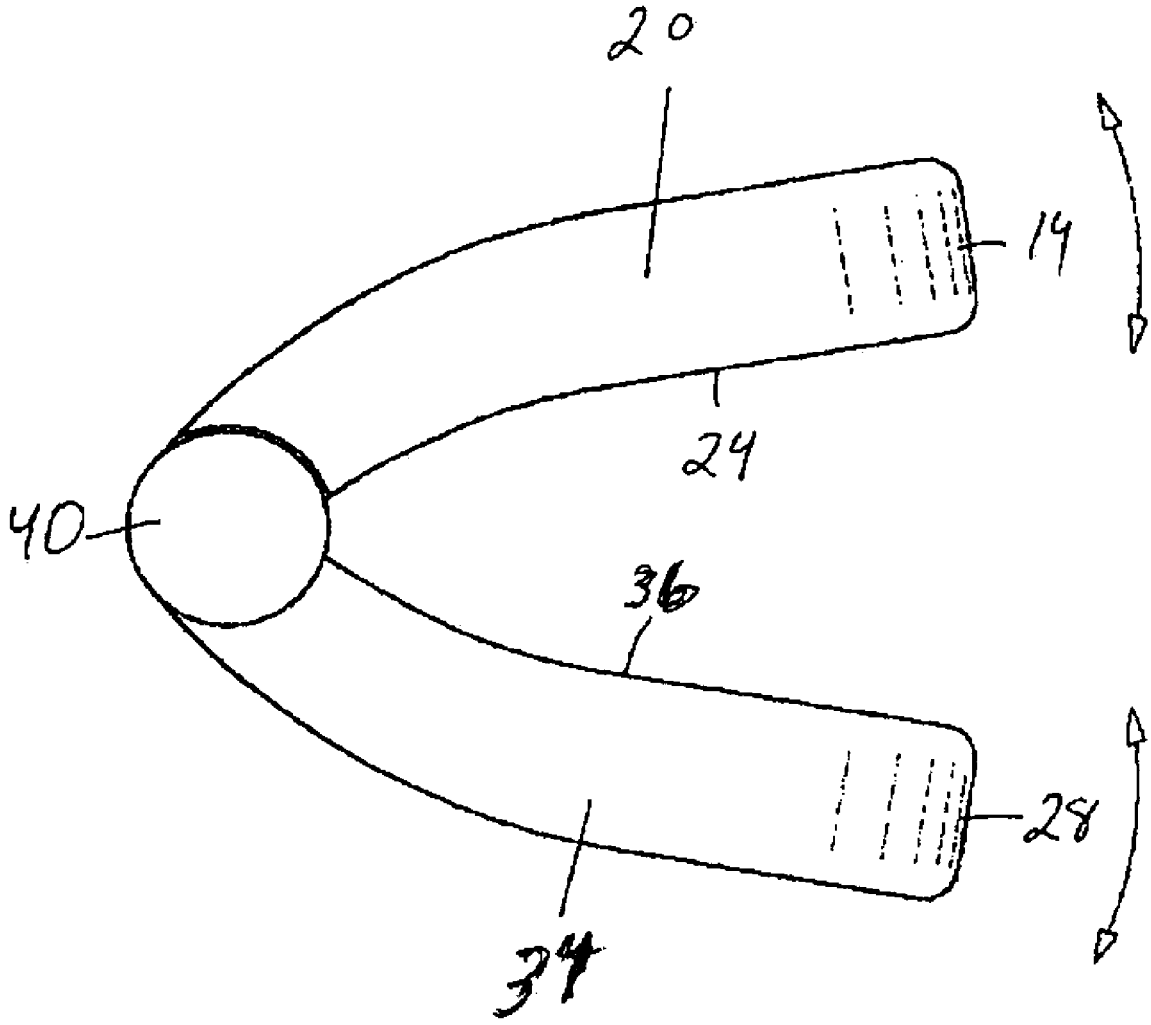
FIG. 2 is a side view of the exercise apparatus for the jaw and facial muscles.

FIG. 2 is a side view of the exercise apparatus for the jaw and facial muscles, and the arrows show the direction of movement the plates 12 and 26 move during use. The right edges 20 and 34 are shown, as are the outer walls 44 and 50. The connection means 40 is shown from the side.

Figure 3:
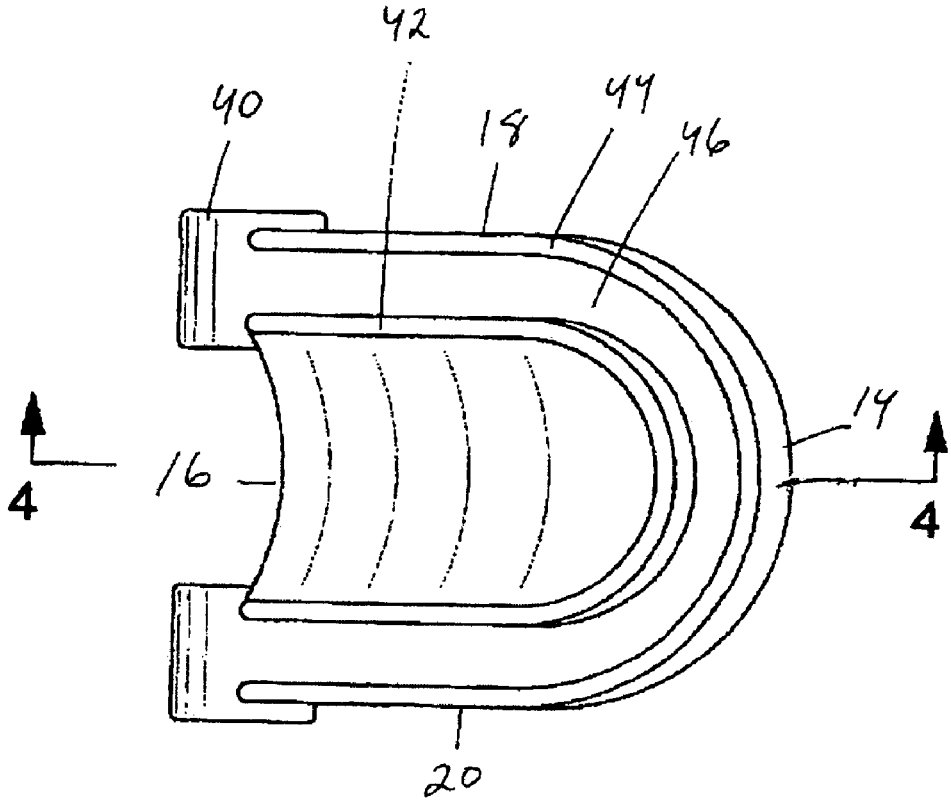
FIG. 3 is a top view of the exercise apparatus for the jaw and facial muscles.

FIG. 3 is a top view of the exercise apparatus for the jaw and facial muscles, and shows the upper side 22 of the first plate 12. The inner wall 42 and outer wall 44 extend upwardly from the first plate upper side 22 to form a channel 46. Also shown are the front 14, back 16, left 18 and right 20 edges. The connection means 40 is shown from the top.

Figure 4:
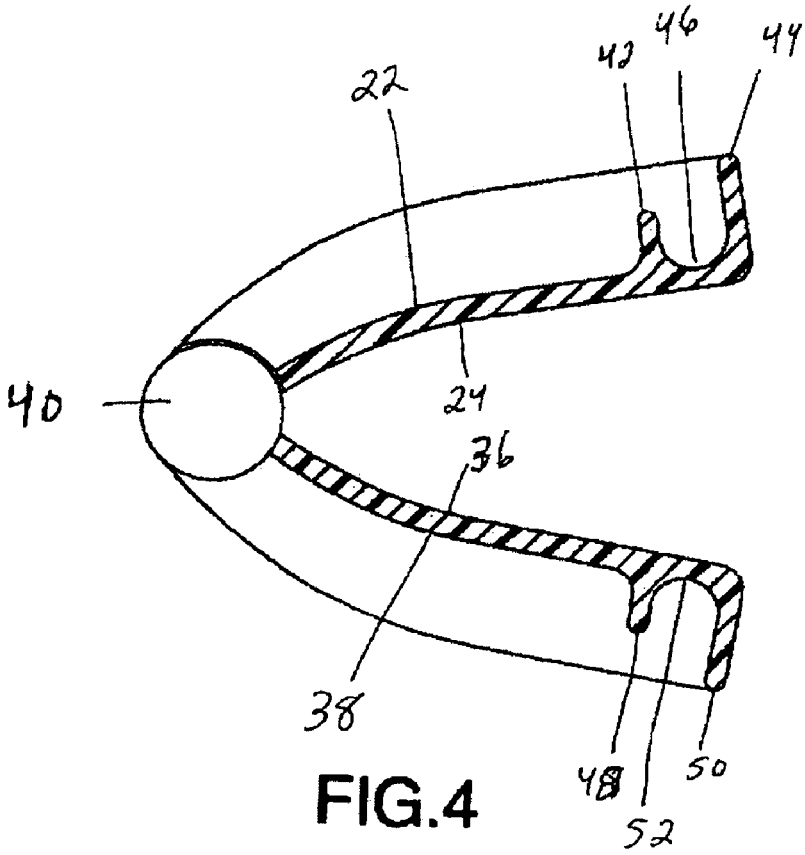
FIG. 4 is a cross sectional view of the exercise apparatus for the jaw and facial muscles, taken essentially along the lines 4-4 of FIG. 3.

FIG. 4 is a cross sectional view of the exercise apparatus for the jaw and facial muscles, taken essentially along the lines 4-4 of FIG. 3. The first plate 12 has front 14, back 16, left 18, and right 20 edges, and upper 22 and lower 24 sides and the second plate 26 has front 28, back 30, left 32 and right 34 edges, and upper 36 and lower 38 sides. A connection means 40 is located at the back edges 16 and 30, and is shown from the side. The inner wall 42 and outer wall 44 that extend upwardly from the first plate upper side 22 to form the channel 46, and the inner wall 48 and outer wall 50 that extends downwardly from the second plate lower side 38 to form the channel 52 are shown. The channels 46 and 52 are adapted to engage the user's teeth.

Figure 5:
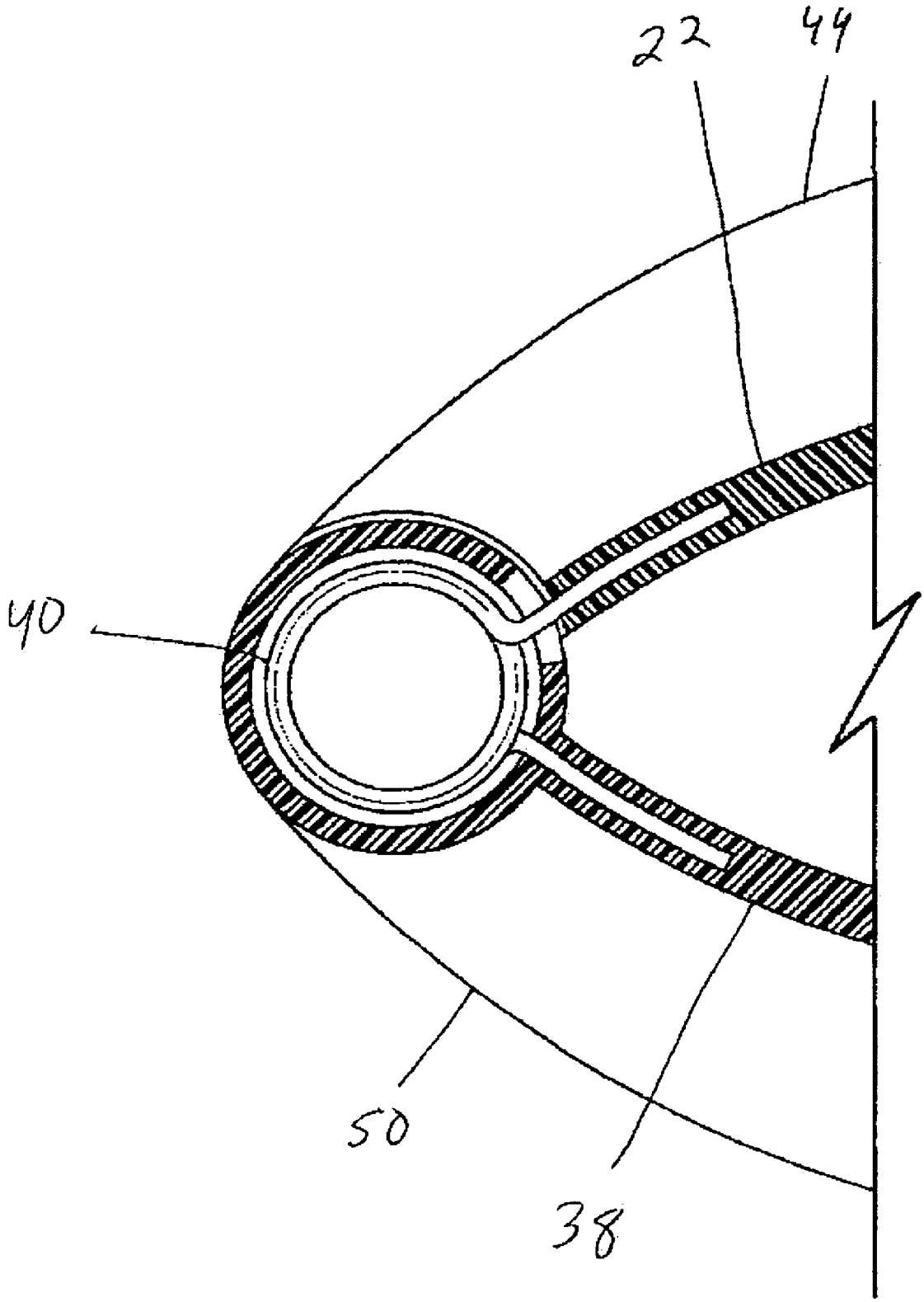
FIG. 5 is a close-up cross sectional view of the exercise apparatus for the jaw and facial muscles, taken essentially along the lines 5-5 of FIG. 1.

FIG. 5 is a close-up cross sectional view of the exercise apparatus for the jaw and facial muscles, taken essentially along the lines 5-5 of FIG. 1. The first and second plates 12 and 26, and the first plate lower side 24 and second plate upper side 36 are shown. The connection means 40 is shown from the side, and is shown as a hinge with a torsion spring.

The present invention is essentially a pair of generally unshaped first and second plates that are sized to fit within a human mouth. The plates have front, back, left, and right edges, and upper and lower sides. There is a connection means at the back edge, which is preferably a hinge. There is also an inner wall and an outer wall extending outwardly from the plates to form a channel. Thus the upper side of the first plate has a channel, and the lower side of the second plate has a channel. The channel is adapted to engage the user's teeth. The hinge can be used to provide resistance, and can be a spring loaded hinge assembly.

In use, it can now be understood that the present invention is placed within the mouth and the teeth are aligned into the channels. The user then begins to repetitively compress the plates thereby working the muscles of the jaw and concomitantly the musculature that underlies the face. Through repeated use the muscles are strengthened and the overall tone and strength of the involved muscles are improved.

While a preferred embodiment of the exercise apparatus for the jaw and facial muscles has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as polymer, plastic, or a variety of rubber may be used to form the device. And although use to improve musculature has been described, it should be appreciated that the exercise apparatus for the jaw and facial muscles herein described is also suitable for providing rehabilitative uses also.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An exercise apparatus for the jaw and facial muscles comprising:

a generally u-shaped first plate having a front edge and a back edge, a left edge and a right edge, and an upper side and a unitary lower side continuously extending from said front edge to said back edge and from said left edge to said right edge, which is sized to fit within a human mouth;

a generally u-shaped second plate having a front edge and a back edge, a left edge and a right edge, and a unitary upper side continuously extending from said front edge to said back edge and from said left edge to said right edge and a lower side, which is sized to fit within a human mouth;

a connection means at said back edges fitting within a human mouth;

an inner wall and an outer wall extending upwardly from said upper side of said first plate to form a channel, wherein said channel engages a user's teeth;

an inner wall and an outer wall extending downwardly from said lower side of said second plate to form a channel, said channel adapted to engage the user's teeth;

wherein said connection means is a spring loaded hinge assembly for providing resistance.

* * * * *